US006568503B2

(12) United States Patent
Proni

(10) Patent No.: US 6,568,503 B2
(45) Date of Patent: May 27, 2003

(54) LOUDSPEAKER WITH IMPROVED MOUNTING STRUCTURE FOR THE SURROUND

(75) Inventor: Lucio Proni, Weston, FL (US)

(73) Assignee: JL Audio, Inc., Miramar, FL (US)

( * ) Notice: Subject to any disclaimer, the term of this patent is extended or adjusted under 35 U.S.C. 154(b) by 0 days.

(21) Appl. No.: 09/952,658

(22) Filed: Sep. 13, 2001

(65) Prior Publication Data

US 2003/0047377 A1 Mar. 13, 2003

(51) Int. Cl.[7] ..... G10K 13/00
(52) U.S. Cl. ..... 181/172; 181/171
(58) Field of Search ..... 181/171, 172; 381/386, 395, 398, 423, 432, 433

(56) References Cited

U.S. PATENT DOCUMENTS

| | | | | | |
|---|---|---|---|---|---|
| 1,778,693 | A | | 10/1930 | Semple, Jr. | |
| 2,755,343 | A | | 7/1956 | Levy | 179/115.5 |
| 3,684,052 | A | | 8/1972 | Sotome | 181/32 R |
| 3,892,289 | A | | 7/1975 | Rollins | 181/171 |
| 4,122,314 | A | | 10/1978 | Matsuda et al. | 179/115.5 R |
| 4,565,905 | A | * | 1/1986 | Nation | 381/182 |
| 5,099,949 | A | | 3/1992 | Mitobe | 181/171 |
| 5,111,510 | A | | 5/1992 | Mitobe | 381/193 |
| 5,115,474 | A | | 5/1992 | Tsuchiya et al. | 381/158 |
| 5,371,805 | A | | 12/1994 | Saiki et al. | 381/192 |
| 5,687,247 | A | * | 11/1997 | Proni | 181/171 |
| 5,949,898 | A | * | 9/1999 | Proni | 181/171 |

* cited by examiner

*Primary Examiner*—Kim Lockett
(74) *Attorney, Agent, or Firm*—Holland & Knight LLP

(57) ABSTRACT

A loudspeaker is provided including a frame formed with an upper end having a seat which receives the outer edge of a surround. The surround is retained within the seat by the combination of an o-ring in contact with the surround, and a C-shaped clamp having an upper arm which engages the o-ring and a lower arm releasably mounted to the upper end of the frame.

15 Claims, 3 Drawing Sheets

LOUDSPEAKER WITH IMPROVED MOUNTING STRUCTURE FOR THE SURROUND

FIELD OF THE INVENTION

This invention relates to loudspeakers, and, more particularly, to a loudspeaker having the combination of an o-ring and C-clamp for removably mounting the outer end of the surround of the loudspeaker to the frame.

BACKGROUND OF THE INVENTION

Loudspeakers generally comprise a frame, a motor structure, a diaphragm, a lower suspension or spider and a surround. In one common type of speaker, the motor structure includes a permanent magnet mounted between a top plate and a back plate, a pole piece centrally mounted on the back plate and a voice coil axially movable with respect to the pole piece. The voice coil includes a hollow, cylindrical-shaped former having an outer surface which receives a winding of wire.

One end of the diaphragm is connected to the surround or upper suspension, which, in turn, is mounted to the upper end of the frame. The lower suspension or spider is connected at one end to a seat formed in the frame at a point between its upper and lower ends. The free ends of the diaphragm and spider are mounted to the voice coil and support it within an air gap between the pole piece and top plate of the motor structure, with the former of the voice coil concentrically disposed about the pole piece. In some speaker designs, a dust cap is mounted to the diaphragm in position to overlie the voice coil and pole piece to protect them from contaminants.

In the course of operation of a speaker of the type described above, electrical energy is supplied to the voice coil causing it to axially move relative to the pole piece and within the air gap formed between the top plate and pole piece. The spider and surround move with the excursion of the voice coil and function to maintain the voice coil centered to avoid rocking or rubbing against the pole piece of the motor.

Surrounds are typically constructed from materials such as rubber, compressed foam rubber, corrugated cloth, paper, plastic and other materials. In many speaker designs, surrounds are also referred to as a "roll" and comprise a semi-circular corrugation formed of rubber. These types of surrounds or rolls have a radially outwardly extending outer edge which is conventionally glued to a flat extension or rim formed at the upper end of the frame of the loudspeaker which also acts as the mounting flange for the speaker. This construction sacrifices a significant amount of diaphragm area, compared to the overall, outside diameter of the speaker, and a reduction in diaphragm area adversely affects the output and efficiency of the speaker.

Another issue with the construction of loudspeakers having the surround glued to the frame involves difficulties in repairing or replacing one or more of the moving parts. Conventionally, the surround, spider and diaphragm are cut away, and the frame and motor are stripped down with chemicals or hand scraped to remove adhesive residue. The new diaphragm, voice coil, surround and spider are then glued together and secured to the loudspeaker frame. This operation requires precise alignment and is usually performed by skilled technicians employing specialized gauges or alignment spacers. Additionally, care must be taken to replace the worn, damaged or outdated moving parts with ones which match the existing motor structure and frame, and can perform the intended task of the speaker, e.g. concert sound reinforcement, automotive sub-bass, home theater and the like.

U.S. Pat. Nos. 5,687,247 and 5,949,898 to Proni address many of the deficiencies of surround construction noted above. In these designs, the surround is removably attached to the outer edge of the upper end of the frame thus allowing a larger diameter surround to be used compared to the prior art. In turn, the effective area and linear displacement of the diaphragm is increased allowing for the design of long-excursion loudspeakers with enhanced performance characteristics. The method of attachment of the surround in the two Proni patents noted above includes, in some embodiments, the use of a flexible o-ring which engages an outer portion of the surround and forces it into contact with a recess formed in the outer edge of the frame. One advantage of this construction is that no adhesive is required, and the surround can be readily removed to permit access to the other elements of the speaker for repair or replacement.

Notwithstanding the improvements obtained with the design disclosed in the Proni patents noted above, some limitations remain. It has been found that the recess formed in the outer edge of the frame to receive the surround may have rough edges which can cause the surround to tear when it is forced into place by the o-ring or during operation of the speaker. Additionally, the o-ring is susceptible to being dislodged from its position against the surround and within the recess in the frame. It is a flexible, resilient circular-shaped member, not unlike a rubber band, and is completely exposed on the exterior of the speaker. Particularly during installation of loudspeakers which incorporate the surround mounting structure of the Proni patents, such as subwoofers in automotive sound systems, the exposed o-ring may be dislodged from its position on the frame. In addition to physical contact with the o-ring, it can also be moved or dislodged during operation of the speaker especially in applications where the o-ring is used in high excursion speakers mounted within a box or enclosure. Substantial pressures are generated within the box interior in the course of speaker operation, and the o-ring must create an effective seal between the surround and frame for the speaker to function properly. These high pressures could result in sufficient movement of the o-ring to compromise the seal at the surround and frame and/or allow the surround itself to move, both of which would have significant negative effects on the performance and sound quality of the speaker.

SUMMARY OF THE INVENTION

It is therefore among the objectives of this invention to provide a loudspeaker having a secure but removable attachment between the surround and frame, which is easy to install and remove for repair or replacement of the moving parts of the speaker.

These objectives are accomplished in a loudspeaker including a frame formed with an upper end having a seat which receives the outer edge of a surround. The surround is retained within the seat by the combination of an o-ring in contact with the surround, and a C-shaped clamp having an upper arm which engages the o-ring and a lower arm releasably mounted to the upper end of the frame.

In one presently preferred embodiment, the outer edge of the surround is formed with a foot portion connected to an end segment, both of which rest against surfaces of the seat in the upper end of the frame. The o-ring engages the surround at the juncture of the foot portion and upper segment, forcing it against the frame seat. With the o-ring in place, the C-clamp is then installed such that its upper arm overlies the o-ring and the lower arm bears against a horizontally extending ledge forming part of the seat. Much of the clamping force exerted against the outer edge of the surround is provided by the o-ring, but the clamp also forces the o-ring against the foot portion of the surround. Additionally, the clamp completely covers the o-ring which protects it from being dislodged by contact during installation or transport of the loudspeaker, or during high excursion operation.

In an alternative embodiment, the continuous, annular C-clamp is replaced with a number of individual clamp segments each having the same cross section as the C-clamp but extending only part way along the circumference of the o-ring. A number of clamp segments are employed to retain the o-ring in place, and at least partially cover it, which are spaced from one another as desired.

Whether a continuous C-clamp or clamp segments are employed, a still further embodiment of this invention involves the addition of a channel structure at the upper or top end of the clamp(s). This channel structure is formed by an inner, annular lip and an outer ring which are spaced from one another to form a channel sized to receive a grill via an interference fit. The grill is a generally semi-circular shaped section of wire mesh which functions to cover and protect the surround and diaphragm from impact during use of the speaker.

DESCRIPTION OF THE DRAWINGS

The structure, operation and advantages of the presently preferred embodiment of this invention will become further apparent upon consideration of the following description, taken in conjunction with the accompanying drawings, wherein.

DETAILED DESCRIPTION OF THE PREFERRED EMBODIMENT

Figure 1:
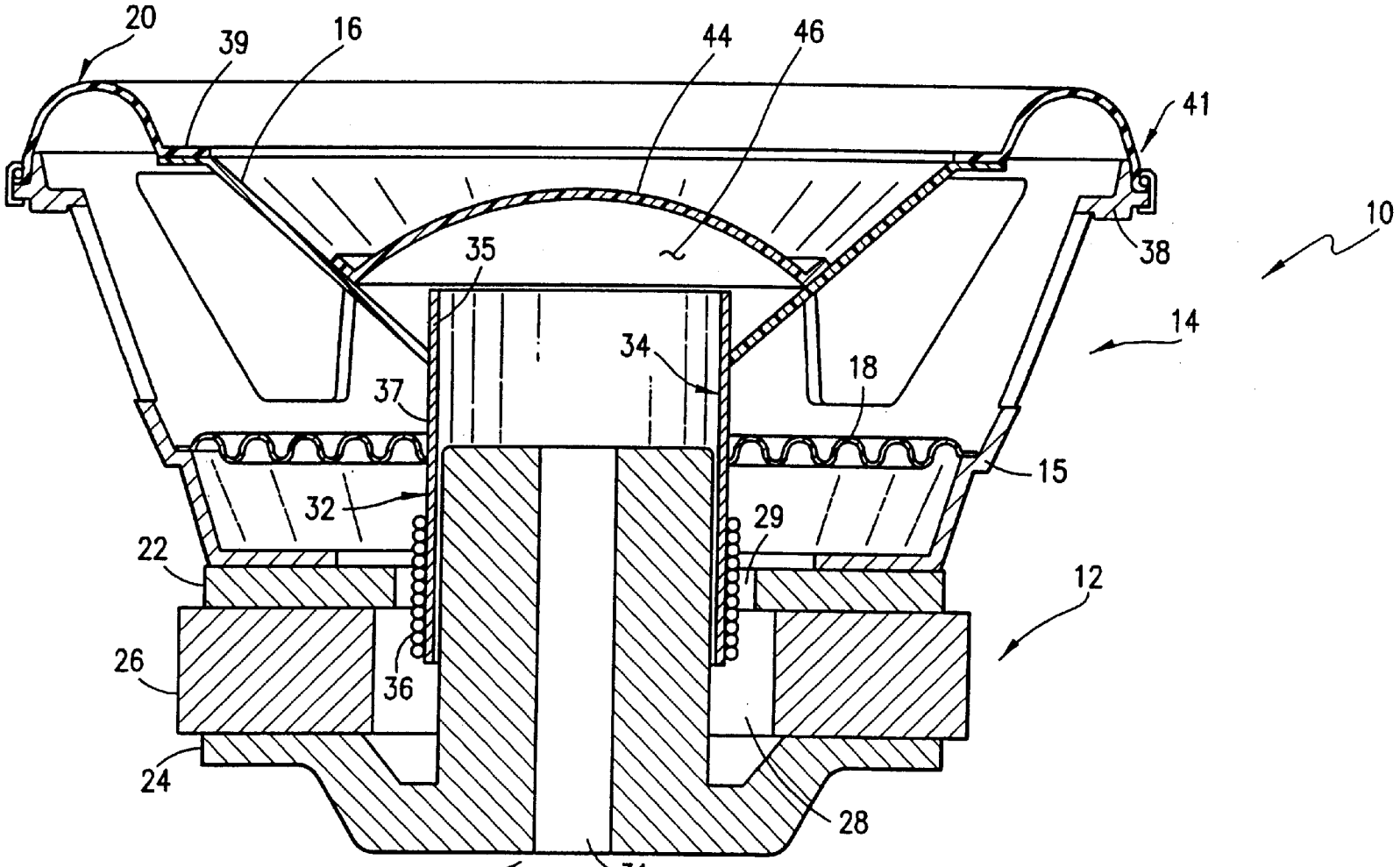
FIG. 1 is a cross sectional view of a loudspeaker incorporating the surround attachment of this invention.

Referring to Figs., a loudspeaker 10 is illustrated which generally comprises a motor structure 12, a frame 14 mounted to the motor structure 12, a diaphragm 16, a lower suspension or spider 18 and an upper suspension or surround 20. Conventionally, the motor structure 12 includes a top plate 22 and a back plate 24 which are spaced from one another and mount a permanent magnet 26 therebetween. A pole piece 30 having a throughbore 31 is integrally formed with and extends upwardly from the back plate 24 into a central bore 28 formed in both the magnet 26 and top plate 22. An air gap 29 is located between the top plate 22 and the pole piece 30, as shown. A voice coil 32 is also provided which includes a hollow, cylindrical-shaped former 34, having an inner surface 35 and an outer surface 37 which receives a wire winding 36. The former 34 is concentrically disposed about the pole piece 30, and the voice coil 32 is axially movable within the air gap 29 during operation of the speaker 10.

The voice coil 32 is held in place with respect to the pole piece 30 by the diaphragm 16, spider 18 and surround 20. One end of the diaphragm 16 is affixed to the former 34 by adhesive or the like, and its opposite end connects to the inner edge 39 of the surround 20. The outer edge 41 of the surround 20, in turn, is mounted to the upper end 38 of the frame 14 as described in detail below. The diaphragm 16 and surround 20 collectively provide support for the voice coil 32, in addition to the lower suspension or spider 18. As shown in the Figs., one end of the spider 18 connects to the former 34, and its opposite end mounts to a seat 15 formed in the frame 14.

A dust cap 44 is mounted to the diaphragm 16 in position to overlie the voice coil 32 and pole piece 30 in order to protect such elements from dirt, dust and other contaminants. A dust cap cavity 46 is therefore formed in the area defined by the lower portion of the diaphragm 16, the dust cap 44, the voice coil 32 and the pole piece 30. In response to the input of electrical energy to the wire winding 36, the voice coil 32 is moved axially with respect to the fixed motor structure 12. Because the diaphragm 16, spider 18, surround 20 and dust cap 44 are operatively connected to the former 34, such elements also move with the excursion of the voice coil 32.

For purposes of the present discussion, the term "upper" or "top" refer to the vertically upward direction of the speaker 10 in its orientation as depicted in FIG. 1, while "lower" or "bottom" refer to the opposite direction. "Outer" refers to a radially outward direction in relation to the longitudinal axis of the voice coil 32 and pole piece 30, whereas "inner" means the opposite direction.

Figure 2:
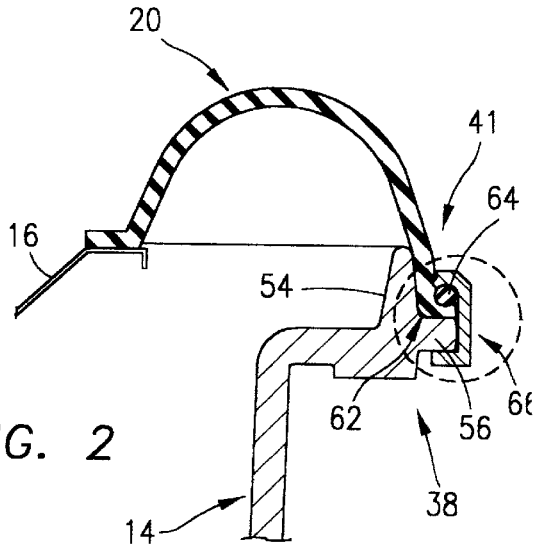
FIG. 2 is an enlarged, cross sectional view of the surround attachment structure employed in the loudspeaker shown in FIG. 1.
Figure 3:
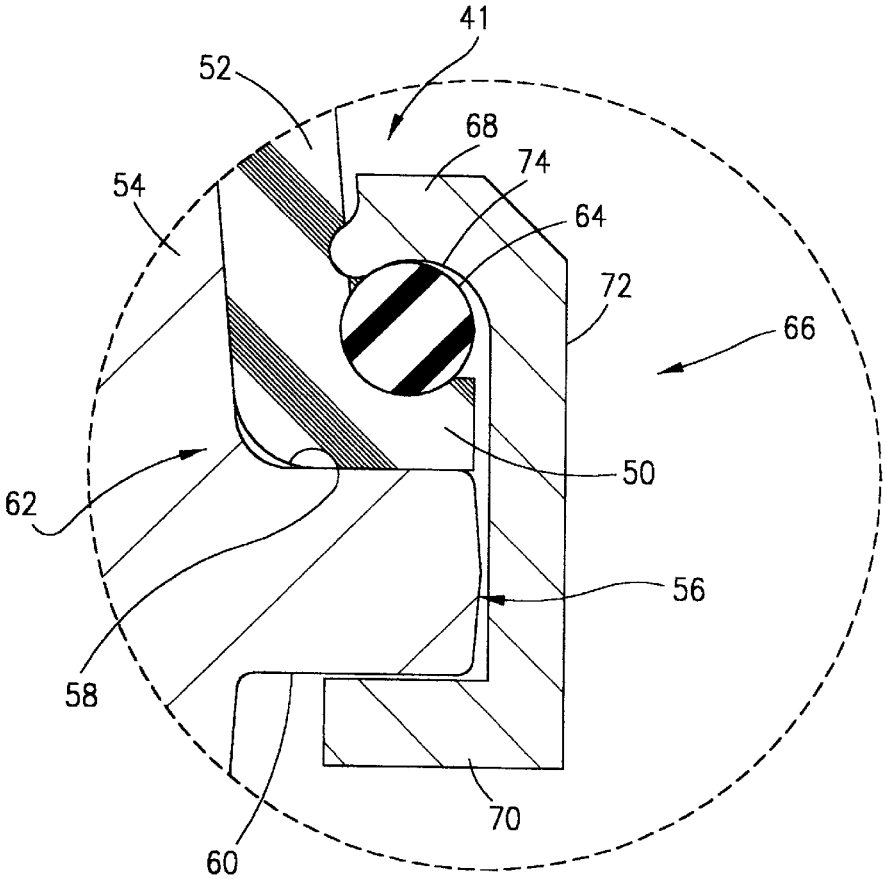
FIG. 3 is an enlarged, cross sectional view of the circled portion of FIG. 2.

With reference to FIGS. 2 and 3, the attachment of the surround 20 to the upper end 38 of the frame 14 is shown in detail. In the presently preferred embodiment, the outer end 41 of the surround is formed with a foot portion 50 which extends generally perpendicularly to an end segment 52. The upper end 38 of the frame 14 includes a generally vertically extending annular ring 54 connected to a horizontal ledge 56 having an upper surface 58 and a spaced, lower surface 60. The annular ring 54 and ledge 56 collectively form a seat 62. The seat 62 is positioned to receive the outer end 41 of the surround 20 such that the foot portion 50 rests atop the upper surface 58 of the ledge 56, and the end segment 52 bears against the annular ring 54.

In the embodiment of FIGS. 2 and 3, the outer end 41 of the surround 20 is maintained in place within the seat 62 by the combination of an o-ring 64 and a continuous, annular C-shaped clamp 66 having an upper arm 68, a lower arm 70 and a center section 72 extending between the arms 68, 70. Preferably, the o-ring 64 is formed of a comparatively stiff material such as metal, and the clamp 66 is made of a deformable material such as a thin sheet of extruded aluminum. Initially, the o-ring 64 is installed such that it engages the outer end 41 of the surround 20 at the juncture of the foot portion 50 and the end segment 52. The o-ring 64 exerts a force which urges the outer end 41 in a generally radially inward and downward direction, holding the end segment 52 tightly against the annular ring 54 of the upper end 38 of the frame 14. With the o-ring 64 in place, the clamp 66 is then snap-fit into place in the position depicted in FIGS. 2 and 3. The upper arm 68 of the clamp 66 has an arcuate, inner surface 74 which at least generally matches the contour of the o-ring 64. As shown, the upper arm 68 engages the o-ring 64 while the lower arm 70 of the clamp 66 bears against the lower surface 60 of the horizontal ledge 56 of seat 62. The vertical distance between the upper portion of the o-ring 64 and the lower surface 60 of the ledge 56 is such that the arms 68 and 72 force or squeeze the o-ring 64 into the relatively plaint material of the surround 20 thus causing the arms 68, 72 to "snap-fit" into place. As a result, the o-ring 64 is urged in a vertically downward direction into tight engagement with the upper surface 58 of the ledge 56 of the seat 62. This ensures that the outer end 41 of the surround 20 is completely sealed and tightly engaged with the outer end 38 of the frame 14.

In addition to the clamping force exerted by the clamp 66, is should be understood that the clamp 66 is dimensioned to completely cover the o-ring 64 after installation. With the o-ring 64 unexposed, it is not as susceptible to being dislodged or otherwise moved from its position relative to the upper end 38 of the frame 14.

Figure 4:
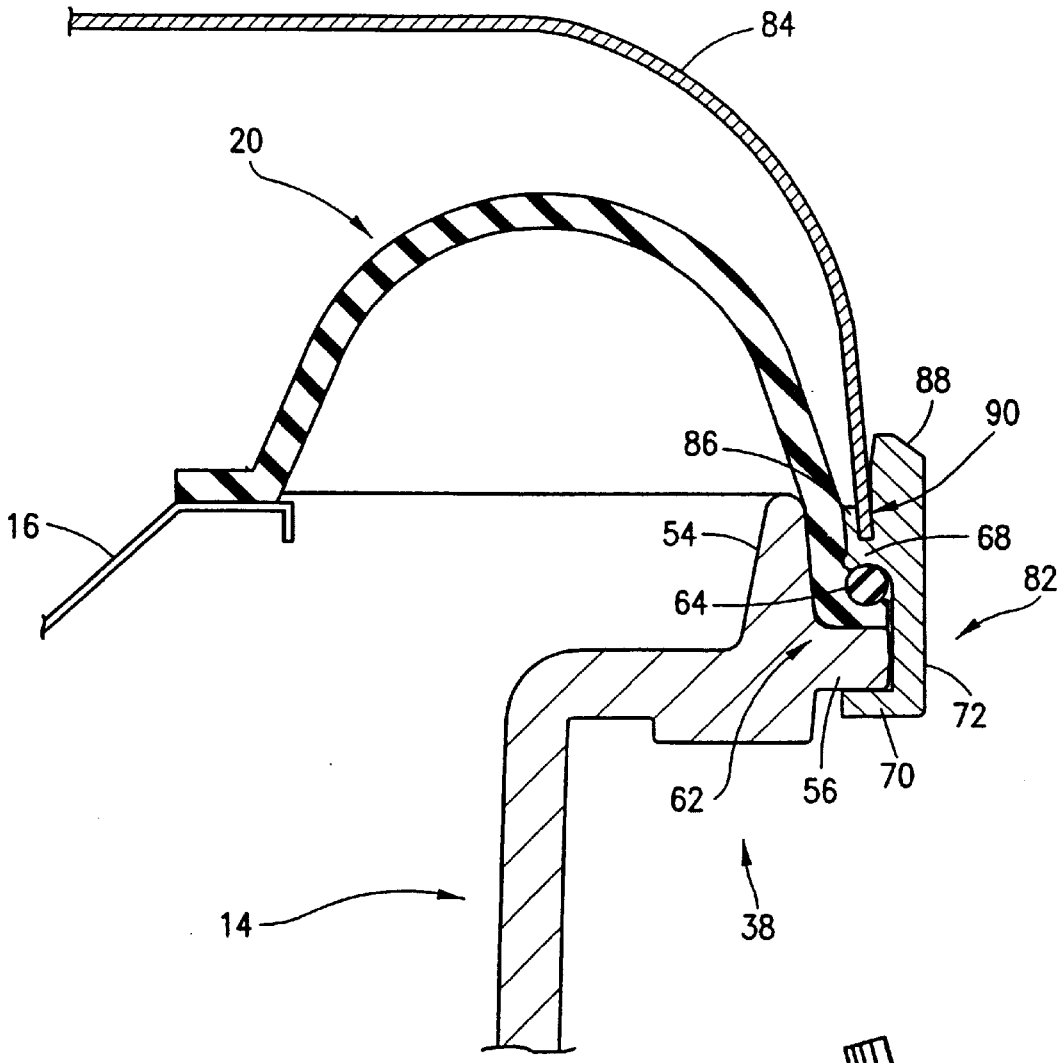
FIG. 4 is a view similar to FIG. 3 except showing a further alternative embodiment of the clamp with a grill mounted to the clamp.
Figure 5:
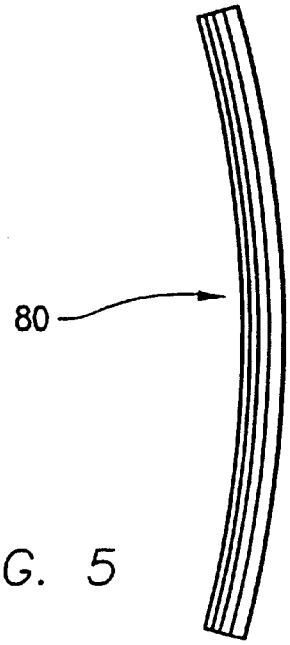
FIG. 5 is a plan view depicting an alternative embodiment of the clamp employed herein.

Referring now to FIGS. 4 and 5, alternative embodiments of the clamp 66 shown in FIGS. 2 and 3 are illustrated. As noted above, the C-shaped clamp 66 is annular in shape and extends continuously around the circumference of the frame 14 and o-ring 64. In the embodiment of FIG. 5, the clamp 66 is replaced by a number of individual clamp segments 80, one of which is illustrated in FIG. 5. Each of the clamp segments 80 extend only along a limited extent of the circumference of the upper end 38 of the frame 14 and the o-ring 64. The clamp segments 80 have the same construction as clamp 66, i.e. an upper arm 68, lower arm 70 and center section 72 therebetween, and connect to the upper end 38 of frame 14 as described above in connection with a discussion of clamp 66. As such, the clamp segments 80 maintain the o-ring 64 securely in position within seat 62, in the same manner as clamp 66, but they do not completely cover the entire circumferential extent of the o-ring 64.

A still further embodiment of a clamp 82 according to this invention is shown in FIG. 4. The clamp 82 is formed with the same upper arm 68, lower arm 70 and center section 72 as clamp 66, and mounts to the upper end 38 of frame 14 in the same fashion, but further includes structure for mounting a grill 84 schematically depicted in FIG. 4. The grill 84 is a generally semi-circular shaped section of metal mesh material which covers the front of the loudspeaker 10 to protect the surround 20 and diaphragm 16 from impact with objects during use of the speaker 10. The mounting structure for the grill 84 comprises an inner lip 86, and an outer ring 88 which is radially spaced from the inner lip 86 to form a channel 90 between the two. The grill 84 is received and mounted within this channel 90 via an interference fit.

While the invention has been described with reference to a preferred embodiment, it should be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. For example, while the mounting structure for the grill 84 is shown as being formed at the top or upper end of clamp 82, which is otherwise identical to clamp 66, it is contemplated that the inner lip 86 and outer ring 88 could be incorporated in the clamp segments 80 to form a channel 90 for mounting of the grill 84.

Therefore, it is intended that the invention not be limited to the particular embodiment disclosed as the best mode contemplated for carrying out this invention, but that the invention will include all embodiments falling within the scope of the appended claims.

What is claimed is:

1. A loudspeaker, comprising:

a motor structure having a movable voice coil;

a frame having an upper end and a lower end connected to said motor structure, said upper end of said frame being formed with a seat;

a surround having an inner end and an outer end;

a diaphragm connected between said inner end of said surround and said voice coil;

a lower suspension connected between said frame and said voice coil;

a mounting assembly including an o-ring which engages said outer end of said surround and a clamp which contacts said o-ring, said o-ring and said clamp retaining said outer end of said surround within said seat at said upper end of said frame.

2. The loudspeaker of claim 1 in which said upper end of said frame is formed with an annular ring and a ledge extending at an angle from said annular ring, said ledge and said annular ring forming said seat.

3. The loudspeaker of claim 2 in which said outer end of said surround includes a foot portion which rests atop said ledge of said seat and an end segment connected to said foot portion, said end segment resting against said annular ring of said seat.

4. The loudspeaker of claim 3 in which said o-ring contacts said outer end of said surround at the juncture of said foot portion and said end segment.

5. The loudspeaker of claim 4 in which said clamp includes an upper arm, a lower arm and a center section extending between said upper and lower arms, said upper arm contacting said o-ring and said lower arm bearing against said ledge of said seat opposite said foot portion of said surround.

6. The loudspeaker of claim 5 in which said clamp is annular and extends continuously about said o-ring.

7. The loudspeaker of claim 5 in which said clamp comprises a number of individual clamp segments each extending along a portion of said o-ring.

8. The loudspeaker of claim 1 in which said o-ring is formed of a rigid material which exerts a force against said outer end of said surround to retain it in place within said seat of said frame.

9. A loudspeaker, comprising:

a motor structure having a movable voice coil;

a frame having an upper end and a lower end connected to said motor structure, said upper end of said frame having a seat formed by an annular ring and a ledge extending at an angle from said annular ring;

a surround having an inner end and an outer end, said outer end being formed with a foot portion connected to an end segment;

a diaphragm connected between said inner end of said surround and said voice coil;

a lower suspension connected between said frame and said voice coil;

a mounting assembly including an o-ring and a clamp, said o-ring engaging said outer end of said surround at the juncture of said ledge and said end segment and said clamp contacting said o-ring, said o-ring and said clamp retaining said foot portion of said surround against said ledge and said end segment thereof against said annular ring of said seat in said frame.

10. The loudspeaker of claim 9 in which said clamp includes an upper arm, a lower arm and a center section extending between said upper and lower arms, said upper arm contacting said o-ring and said lower arm bearing against said ledge of said seat opposite said foot portion of said surround.

11. The loudspeaker of claim 10 in which said clamp is annular and extends continuously about said o-ring.

12. The loudspeaker of claim 10 in which said clamp comprises a number of individual clamp segments each extending along a portion of said o-ring.

13. The loudspeaker of claim 1 in which said o-ring is formed of a rigid material which exerts a force against said outer end of said surround to retain it in place within said seat of said frame.

14. A loudspeaker, comprising:

a motor structure having a movable voice coil;

a frame having an upper end and a lower end connected to said motor structure, said upper end of said frame being formed with a seat;

a surround having an inner end and an outer end;

a diaphragm connected between said inner end of said surround and said voice coil;

a lower suspension connected between said frame and said voice coil;

a mounting assembly including an o-ring which engages said outer end of said surround and a clamp which contacts said o-ring, said o-ring and said clamp retaining said outer end of said surround within said seat at said upper end of said frame;

said clamp having an upper end formed with a channel adapted to receive and mount a grill.

15. The loudspeaker of claim 14 in which said upper end of said clamp is formed with an inner lip and an outer ring spaced from said inner lip to form said channel therebetween.

* * * * *